US005815068A

United States Patent [19]

Vadseth

[11] Patent Number: 5,815,068

[45] Date of Patent: Sep. 29, 1998

[54] GUIDING LIGHT SYSTEM AND LIGHTING STRIP

[76] Inventor: Jan Erik Vadseth, P.O. Box 10 Teie, Tønsberg, Norway

[21] Appl. No.: 652,435

[22] PCT Filed: Dec. 8, 1994

[86] PCT No.: PCT/NO94/00199

§ 371 Date: Jun. 5, 1996

§ 102(e) Date: Jun. 5, 1996

[87] PCT Pub. No.: WO95/16249

PCT Pub. Date: Jun. 15, 1995

[30] Foreign Application Priority Data

Dec. 8, 1993 [NO] Norway ..... 934463

[51] Int. Cl.[6] ..... G08B 5/00

[52] U.S. Cl. ..... 340/332; 340/628; 340/691; 340/815.4; 362/227

[58] Field of Search ..... 340/332, 286.05, 340/628, 532, 691, 692, 693, 815.61, 815.4; 362/249, 153, 227

[56] References Cited

U.S. PATENT DOCUMENTS

| | | | |
|---|---|---|---|
| 2,085,807 | 7/1937 | Lindsay | 177/355 |
| 3,408,025 | 10/1968 | Davis | 244/118 |
| 4,173,035 | 10/1979 | Hoyt | 362/249 |
| 4,179,160 | 12/1979 | Sabo | 299/12 |
| 4,347,499 | 8/1982 | Burkman et al. | 340/332 |
| 4,531,114 | 7/1985 | Topol et al. | 340/539 |
| 4,801,928 | 1/1989 | Minter | 340/332 |
| 4,962,373 | 10/1990 | Sirois | 340/693 |
| 5,027,262 | 6/1991 | Freed | 362/249 |
| 5,130,909 | 7/1992 | Gross | 362/153 |
| 5,293,155 | 3/1994 | Nicol et al. | 340/692 |
| 5,572,183 | 11/1996 | Sweeny | 340/332 |
| 5,594,410 | 1/1997 | Lucas et al. | 340/332 |

FOREIGN PATENT DOCUMENTS

| | | |
|---|---|---|
| 1394/92 | 11/1992 | Denmark . |
| 0 261 811 | 3/1988 | European Pat. Off. . |
| 0 323 682 | 12/1989 | European Pat. Off. . |
| 0 401 038 | 5/1990 | European Pat. Off. . |
| 2 494 975 | 11/1980 | France . |
| 1 498 483 | 1/1978 | Germany . |
| 35 24 457 | 1/1987 | Germany . |
| 40 02 095 | 8/1991 | Germany . |
| 185269 | of 0000 | Japan . |
| 2 140 604 | 11/1984 | United Kingdom . |
| 2 157 470 | 10/1985 | United Kingdom . |
| 2 199 176 | 6/1988 | United Kingdom . |
| 2 215 105 | 9/1989 | United Kingdom . |
| 2 223 871 | 4/1990 | United Kingdom . |
| 2 225 661 | 6/1990 | United Kingdom . |
| 2 251 327 | 1/1992 | United Kingdom . |
| WO 89/04410 | 5/1989 | WIPO . |

*Primary Examiner*—Jeffrey A. Hofsass
*Assistant Examiner*—Davetta Woods
*Attorney, Agent, or Firm*—Zarley, McKee, Thomte, Voorhees & Sease

[57] ABSTRACT

A light system comprising controllable light sources (35) positioned along alternative routes of movement to serve a s optical means for influencing persons to follow an indicated route of movement to one selected of a plurality of target areas, the system having control means (1,2) for turning light sources on and off to generate along the route indicated a moving light effect traveling in the direction of target area selected. At least one display unit (13) is provided for presenting a general view of alternative routes of movement along which the light sources are located. In response to an assignment command entered through input means (11) included in the system, processing and communication means (12, 14, 21, 22) activate the traveling light along each route assigned. In the system, a modular light-rail (3) adapted for directing persons by means of said traveling light effect in one selected of two opposite directions along the rail, is provided with low power light sources (35, 36), preferably of the type having light emitting diodes, disposed as to illuminate a reflecting field.

25 Claims, 4 Drawing Sheets

GUIDING LIGHT SYSTEM AND LIGHTING STRIP

TECHNICAL FIELD

Present invention relates to a guiding light system comprising controllable light sources which can be used as optical means for influencing persons to follow an assigned route of movement to one selected of a plurality of target areas, wherein said light sources are disposed along alternative routes of movement, and the system further comprising operation control means for turning light sources on and off in such a way that light sources located along the assigned route, indicate movement in the direction of the target area selected, in the form of travelling light. The invention also relates a lighting strip adapted to be used as optical means for influencing persons to follow one designated of two opposite directions of a movement along the lighting strip.

BACKGROUND ART

In places open to the public there exists in many situations a need for informing and guiding persons so that they with greater ease are able to find their way and particularly find the way to a desired target area, the location of which being unknown to them, or for various reasons, being difficult to find out. For this purpose it is known to install various types of devices in places where people gather or commute, and which, by means of sound and/or light signals can convey information intended to influence the behaviour of persons, so that they move in the direction of the desired target area.

In this way, it is previously known several devices which use optical means to indicate a path or route of movement which people in a given situation should follow. In particular, such devices are known which are installed on board ships and accommodation platforms as well as in hotels, hospitals, shopping centres, cinemas, theatres or other places where the public or customers are given admission and which provide for a certain permanent escape route meant to be used in an emergency situation.

As an example of such a system for indicating a predetermined escape route which cannot be altered, a system is known from GB Patent No. 1 498 483 which comprises both sound and light sources disposed along the fixed escape route, and where the light sources may be caused to emit light sequentially so that the light is perceived to travel along the fixed, predetermined escape route in one direction only, towards one specific emergency exit, for example. From this GB Patent it appears that the light sources are mounted on the wall approximately at head level above the floor in e.g. corridors, in such a way that there will be long voids between the light sources at door openings and openings to branching corridors as well as in open spaces, such as lobbies. Such discontinuities in the visual marking of the escape route contribute to the necessity of completing the system with sound sources which not only makes the system more expensive, but also the installation and operation of the same.

However, the most important disadvantage by such systems for indicating a predetermined escape route which cannot be altered, is the fact that in a certain, real emergency situations the predetermined escape route in question may be blocked by e.g. fire or gas leakage, which may bring people who follow the indication, into utmost mortal danger. In addition, the marked predetermined escape route may be unsuitable for other reasons, such as those pertaining to the method of evacuation.

With the systems described in GB Patent Application No. 2 215 105 and U.S. Pat. No. 4,347,499, respectively, attempts are made to overcome this problem by connecting the light sources to a control device linked to sensors disposed to detect possible blocking of corresponding emergency exits and which, if a blocking is detected, automatically provides for control of the travelling light from the light sources in the direction of exits which are not detected as being blocked. With the system described in GB Patent Application No. 2 215 105 it is also possible to inititate evacuation manually by means of trigger devices disposed along the escape routes. However, the escape route pattern which automatically adapts to the detected blockings cannot be amended, even when there are reasons for interfering and take command of the automatic system, which may desireable e.g. in the event of an incorrectly detected blocking, or by a blocking of an exit, or the safety zone behind this, which cannot be detected automatically.

Due to the insufficient realibility of available sensors for detecting smoke or gas, or other conditions threatening the safety, it is, however, in many situations not desirable to have a fully automatic activation of an alarming travelling light, such as described above, since this may create unnecessary anxiety and bewilder, particularly in cases of false alarms.

A further disadvantage by the systems known from the publications mentioned above, is that their signal sources with the corresponding connecting wires, housing for integral mounting, and so on, are not particularly well suited for post-installation in buildings and crafts. For example, the light source housings which in U.S. Pat. No. 4,347,499 are shown lowered into recessions in the floor between the cabin and the cargo room of a passenger aircraft, would weaken the structure of the floor to such a large extent that utilization in practice hardly is permissable.

DISCLOSURE OF INVENTION

Thus, there is a need for a new system of the kind described initially, whereby the route indications by a command from a human being, rapidly can be adapted to the present situation and which, beyond the ability of functioning according to the intended purpose in different emergency situations, is suitable for general applications, when it is desirable to guide a group of persons to a selected place, for instance within a building, such as a hotel, and where the light sources together with the associated equipment are designed to be post-mounted in a simple way on any substantially flat surface.

This is achieved by means of a system of the kind initially described and which according to the present invention is characterized by the operation control means comprising:

- display means to show a general view of alternative routes of movement along which the light sources are located,
- input means to designate, at any time, one or more of the routes of movement shown, and
- processing and communication means to activate upon command entered through said input means, said travelling light from light sources which correspond to the respective designated route, or routes, of movement.

By means of a system provided with operation control means according to the invention, it becomes possible, in a flexible way, to adapt efficient indications of routes of movement according to the condition present at any one time, and for different purposes.

In a preferred embodiment of the guiding light system according to the invention, the operation control means is arranged to set the travelling light in accordance with a predetermined sequence of switching the light sources on and off, whereby this sequence can be established so that in a series of consecutively numbered light sources, the light sources along the assigned route of movement are caused to light up and go out in consecutively rising or falling numerical order, or with switching between light sources of odd and even numbers, respectively, in the series of light sources, possibly with switching between groups of light sources, but always in such a way that said travelling light as a whole is perceived to indicate movement in the direction of the target area selected, preferably with a velocity of at least 2 m per second.

With such an arrangement, optical effects can be achieved which make the indications of the direction toward the selected target area clearer and also display modes of travelling light which can be perceived differently by an observer, and hence are used for different purposes.

A guiding light system according to the invention preferably comprises a plurality of lighting strip modules, each of which comprising an elongated casing for the internal disposition of a number of light sources, one after the other, the casing at least at each light source being light permeable, and capable of being joined to further such lighting strip modules to form a continuous lighting strip section, which further can be joined to other corresponding lighting strip sections, thereby forming a consecutive lighting strip without voids along each of the routes of movement.

The operation control means of the guiding light system according to the invention is preferably arranged to control one or more continuous lighting strip sections separately or collectively in one or more groups of lighting strip sections, the operation control means comprising a central control unit arranged to control groups consisting of one or more lighting strip sections, by means of a plurality of local control units, each of which being associated with a respective lighting strip section, the local control units being adapted to receive control signals from the central control unit, preferably by way of wireless signal transmission.

As previously mentioned, the invention also relates to a lighting strip adapted to be used as optical means for influencing persons to follow one designated of two opposite directions of movement along the lighting strip. This lighting strip is intended to be used in a guiding light system according to the invention, and which comprises operation control means to control the light function of the lighting strip in such a manner that light sources located in the lighting strip indicate light transfer in the form of a travelling light in the direction of movement designated. The lighting strip according to the invention is characterized in that the light sources are low power light sources, preferably of a type comprising light emitting diodes, disposed to illuminate a reflecting field.

In a preferred embodiment, a non-dazzling light effect is achieved by the feature that the elongated casing of the lighting strip is provided with an optical design in the light permeable portion, preferably formed substantially on the inside of the casing, to cause light from the light sources disposed within the casing to be brought together in bundles of light for emission substantially slanting relative to a line perpendicular to the light permeable portion of the casing, by an angle of between 10 and 30 degrees, preferably 20 degrees, with respect to said line.

BRIEF DESCRIPTION OF DRAWINGS

Further features of the guiding light system and lighting strip according to the present invention will appear from the following description of an example of preferred embodiments thereof, given by reference to the accompanying drawings, on which.

DESCRIPTION OF PREFERRED EMBODIMENTS

Figure 1:
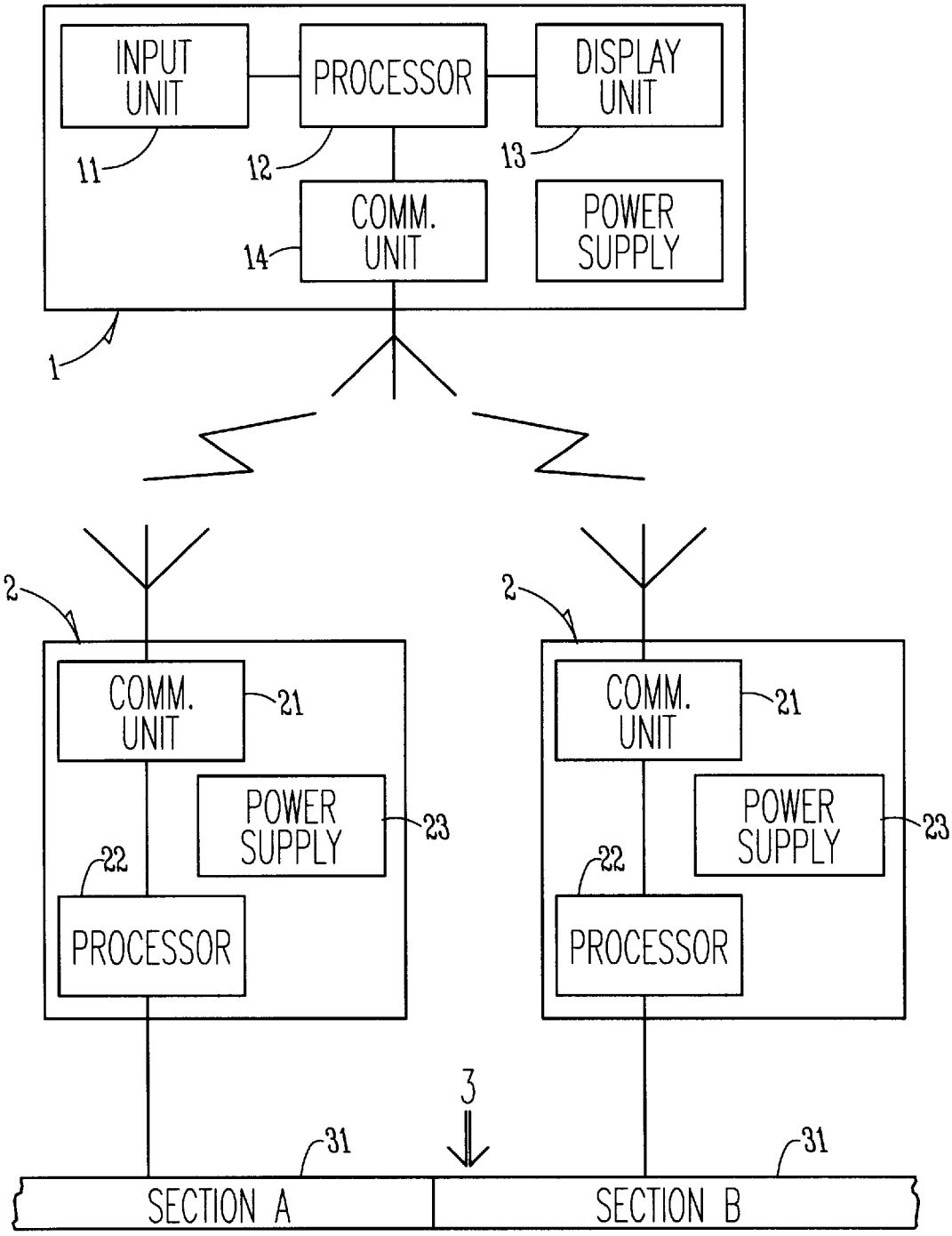
FIG. 1 is a block diagram of an embodiment of the guiding light system according to the invention.

Reference is made to FIG. 1 which schematically shows an example of a guiding light system according to the invention. The guiding light system comprises operation control means which in the embodiment shown is made up of a central control unit 1 and a plurality of local control units 2 (of which only two are shown). The central control unit includes an input unit 11, a processor 12, a display 13 and a communication unit 4, and as shown in Figure, each local control unit 2 is connected to a section 31 of a lighting strip 3.

Advantageously, the central control unit 1 is located in a central place, such as the bridge on a ship, the reception or a manned security room in a building, or a security service centre for a plurality of subscribers. Preferably, the display unit 13 is constituted by a tableau, a screen or the like, showing an outline of the ship or building concerned and including sketch maps of the desired decks of the ship or floors of the building together with an indication of the associated separate lighting strip sections 31 or groups thereof, since it can be advantageously to control the sections in groups depending on the physical configuration of the site where the guiding light system is installed.

In a possible embodiment of the central control unit 1, in which the display unit 13 comprises a video screen, the input unit 11 may take the form of a keypad, a keyboard or pointer device (control ball, mouse) connected to the screen. The display unit 13 may alternatively, in stead or in addition, be a touch or point sensitive screen for direct reception of commands. Another possibility is to incorporate the input unit 11 in a tableau board having knobs and switches with corresponding lamps located in accordance with the lighting strip sections 31, or groups thereof.

In the embodiment shown in the Figure, the communication unit 14 of the central control includes at least one radio transmitter arranged to send control signals to the local control units 2. The control signals, preferably of a frequence within the VHF band, may be transmitted with very low power as compared to mobile telephones, for example, so that other radio or electronic installations are in not a affected a way which e.g. mobile telephones may do.

By commands to the input unit 11 it is then possible to transmit control signals to the local controls 2 in question to activate and deactivate each of the lighting strip sections or groups thereof, and at any time set different appearance alternatives or attributes of the light within each single section or group. Here, the term "attribute" is meant an on-and-off sequence for the light sources in the lighting strip and the direction and velocity of the motion of the travelling light in the lighting strip, as well as possible colours of the emitted light and possibly the setting of one or more light sources to emit steady light. In this way the display unit 13 reflects the settings chosen by showing the light strip sections or groups which at any time is activated, together with corresponding, or the most important of these, attributes.

The central control 1 may also be connected to an alarm system (not shown) to give a warning of fire or other emergency situations, so that predetermined parts of the lighting strip installation are activated in a predetermined way as a function of the location where the alarm is triggered and the kind of alarm condition. Some kind of remote control of the central unit by means of radio communication, for example, is also possible. A possibility may also exist to activate separate lighting strip sections or groups by means of key switches (not shown) provided in the vicinity and with connection to each section or group of sections.

The local control units 2 shown in FIG. 1, each being connected to a section 31 of a lighting strip 3 in accordance with the invention, include a communication unit 21, a local processor 22 and a power supply 23. In the embodiment shown in the Figure, the communication unit 21 contains at least one radio receiver to receive the control signals transmitted from the central control unit 1, as discussed above. If the central control unit 1 is arranged to process return messages from the local units 2, it is, however, necessary that the communication units 14, 21 in the central control 1 and the local controls 2, respectively, are of a transceiver type to allow bidirectional communication. Even though communication by means of radio waves is preferred and, thus, is shown in FIG. 2, such communication is not a requirement, since both unidirectional and bidirectional communication can be achieved by signal transmission via cables, instead. However, radio communication reduces to a minimum the need for laying signal cables, which eases the installation, makes shorter installation periods possible and lower the costs of the installation substantially. Then the signal transmission path is not very much exposed to damage by fire, vandalism or other external influences.

The local processor 22 of the local controls 2 are arranged to set the rate and order by which light sources in the lighting strip section 31 is caused to light up and go out. The processor 22 is designed to make this setting either in accordance with the corresponding instructions received by a control signal from the central control unit 1 or in accordance with fixed instruction settings stored in the local control unit, which in the latter case, also must contain a storage or memory (not shown) for such instructions. The rate with which each light source in the lighting strip section 31 is caused to light up and go out, can be adjusted so that light sources located one after the other in the lighting strip section are caused to light up and go out in a constantly increasing or constantly decreasing rate in accordance with the location in the longitudinal direction of the lighting strip section, thereby giving the travelling light and accelerated or decelerated movement in the direction of movement selected, thus being an indication of the distance to the target area to an observing person.

Depending on the desired effect to be achieved, the light sources in the lighting strip section 31 can be brought to light up and go out with a pause between the switching off of one light source and the switching on of the light source which in accordance with a predetermined sequence, is to be lit, or with an overlap of such switching off and on. The predetermined sequence of switching the light sources 35 on and off will influence the effect produced by the light sources, and by having a suitable sequence, it will be possible to produce travelling lights or "light trains" which move along or "waves along", for example, the lighting strip, and which, as a whole, is perceived to indicate a movement in the direction of the selected target area. The velocity of this movement should be greater than normal walking speed for human beings and in emergency situations at least 2 m/s.

Each local control unit 2 is provided with a separate power supply 23 connected to a main power network, such as the mains in buildings, and including a charging circuit for an accumulator, the capacity of which being adapted to a number of light sources in the associated lighting strip section 31 in such a way that these light sources, by being connected to said accumulator, are maintained effective at least for a predetermined period of time in case of failure in the supply from the main power network. This predetermined minimum time would, for light sources of the preferred type described below, typically amounts to three hours. Whether the accumulator is disposed in the local control unit 2 or in the lighting strip 3 itself, it can be connected to a number of light sources in a lighting strip section 31, so that the light sources automatically are supplied with power for emitting steady light, if a failure occur in the local control unit, or possibly in other parts of the installation.

To protect the local control units 2 from vandalism and other kinds of damage, they should be placed behind roof or wall panels to make them invisible, and if the antenna portion of the local control 21 has to be on the outside of such a panel, it should be encased in an impact resistant material, such as neoprene, which withstands mechanical stresses.

In a system according to the invention the local control units 2 may be connected to equipment arranged to detect an error condition in the associated lighting strip section and convey such a detection to the local control unit, which in turn, informs the central control unit correspondingly via a bidirectional communication link.

Also, a local control unit 2 may be connected to equipment arranged to detect a change of state in the environment of the control unit and deliver a corresponding signal to the local control unit, which in turn, informs the central control unit. Such detectable state changes may arise from in a sensor beginning to detect smoke or gas, for example, or other conditions threatening the security, a fire alarm button being depressed or fire extinguishing equipment being released. A warning of the latter condition may indicate that a starting fire exists, since some people in such cases grab the nearest fire extinguishing equipment as their first reaction, but the warning may also indicate that a fire extinguishing unit not longer is in place and may have been removed by vandals. Such misuse may then be detected quickly and equipment corresponding to the missing unit be put back at once to restore normal operation.

The radiolink to the central control unit 1 may also advantageously be used for giving a warning of several other conditions, such as water leakage, burglary, release of life saving material, and so on, particularly in such places where it is uneconomical or impossible to lay cables.

In addition to said display means 13 of the central control unit 1, the system according to the invention may also comprise a number of distributed display units (not shown) disposed to show a general view of alternative routes of movement to different target areas, and being arranged to indicate in the general view of alternative routes of movements shown, the shortest route of movement to a selected target area, as a response to an input signal designating a selected target area. Input signals to such distributed display units may be given by means of an associated keypad, a card reader for keycards, magnetic cards and the like, or other input equipment, and the display unit may be connected to a printer unit to print e.g. on paper said general view including the assigned shortest route of movement.

Figure 2A:
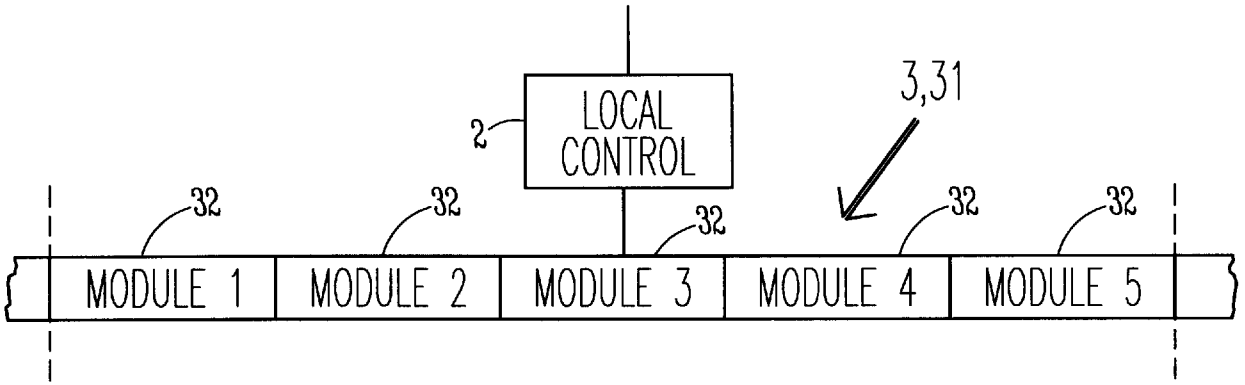
FIGS. 2A and 2B illustrates schematically examples of lighting strip sections made up of five and three light strip modules, respectively.
Figure 2B:
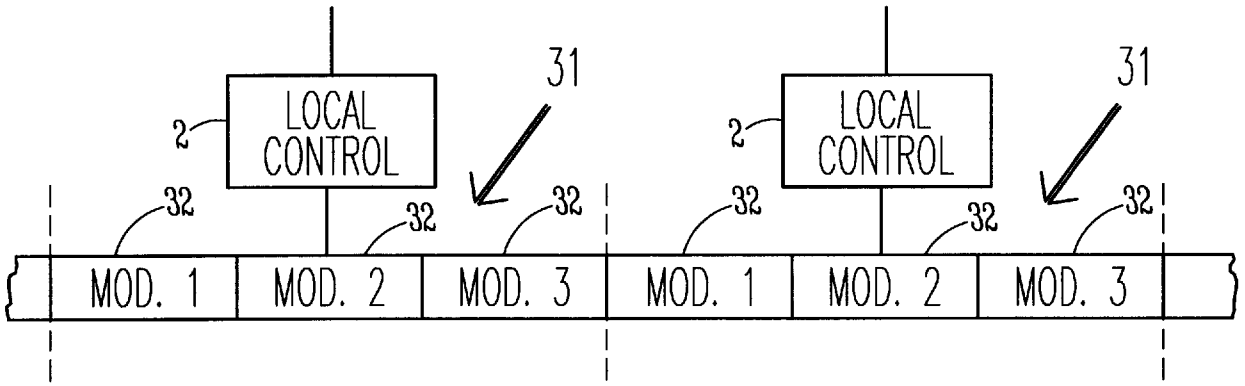

Again reference is made to FIG. 1 showing an embodiment of the invention in which a section 31 of a lighting strip 3 is connected to each local control unit 2. As shown in FIGS. 2A and 2B, preferably a lighting strip 3 according to the invention is made up of a plurality of lighting strip modules 32, each comprising an elongated casing (33, FIG. 4) for internal disposition of a number of light sources (35, FIGS. 3 and 4), one after the other, and which at least at each light source is permeable to light and can be joined to further such lighting strip modules to form a continuous lighting strip section 31, which also may be joined to other corresponding lighting strip sections 31, thereby forming a consecutive lighting strip 3 without voids along each route of movement.

Figure 3:
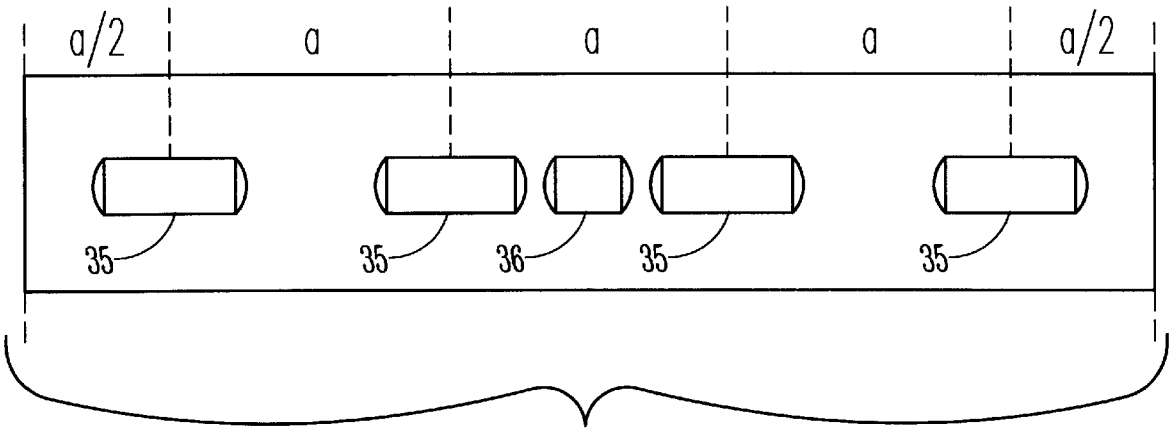
FIG. 3 is a view showing the location of the light sources within a lighting strip casing.

In a preferred embodiment a non-interrupted lighting strip 3 is made up of number of lighting strip modules 32 of the kind shown in FIG. 3, in which a number of light sources 35 are disposed evenly spaced and preferably such that the two light sources located closest to the ends of the module are at a distance from the edge of the module which, as it appears from FIG. 3, equals about half the mutual spacing a of the other light sources. In this way the spacing of the light sources closest to the ends of two joined modules will be approximately the same as the spacing of the other light sources in the two modules. This fact will enchance the continuity of a travelling light in the consecutive lighting strip.

In the embodiment shown in FIG. 3, there is a possible further light source 36 disposed substantially in the middle of the module, and which alone, or together with selected other light sources 35, may serve as emergency light, a possible steady "stand-by light" or the like, preferably with power supplied from a separate accumulator.

The joinable lighting strip modules 34 of the type shown in FIG. 3, may be provided in two stardard lengths, for example, i.e. a shorter type (corresponding to that shown) having four evenly distributed light sources 35 and a length of about 1 m, preferably 113,1 cm, and a longer type including eight such sources and having a length of about 2 m, preferably 226,3 cm. In both cases the distance a between the middle point of the light sources 35 amounts to 25 to 32 cm, preferably 28,3 cm.

Even though such an embodiment is not shown, it is also possible to dispose the light sources with a mutual middle point spacing which gradually diminishes or increases in the longitudinal direction of the lighting strip, e.g. to achieve special effects of the travelling light in selected portions along a direction of movement to influence observing persons accordingly.

Figure 4:
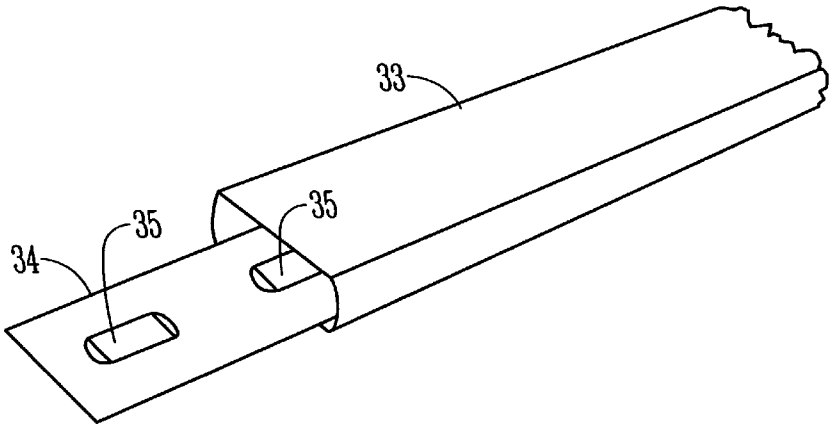
FIG. 4 is a perspective view of a part of a lighting strip module, with the light sources partially pulled out of the casing.

In FIG. 4 a perspective view of a part of a preferred embodiment of a lighting strip module according to the invention is shown with a substrate 34 for mounting of light sources 35 partially pulled out of the casing 33 of the module. The casing is preferably made of a water impermeable, impact resistant material which withstands mechanical loads from i.a. vacuum cleaning and normal travel by foot, preferably a transparent plastic material, such as a polyacrylate or polycarbonate, and the joints in a continuous lighting strip section of assembled lighting strip modules are of a watertight configuration. At least on one longitudinal side, preferably the side opposite the light permeable portion, the casing is provided with attachment means, preferably of a self adhesive type, for direct fixing to a foundation. Such an attachment means may comprise a two-sided adhesive tape placed on the lower outer surface of the casing 33 shown in FIG. 4, and provided with a protective sheet to be released immediately prior to the fixing to a foundation. In the preferred embodiment the casing is of an external height of 6 to 10 mm, preferably 8 mm, and a width of 20 to 25 mm, preferably 23 mm.

The light sources 35, 36 are low power light sources, preferably of a type comprising light emitting diodes, dispopsed to illuminate a reflecting field. Such light sources comprising two light emitting diodes (LEDs) for illimination of an intermediate field which may serve as a background field for a liquid crystal display window, emitting evenly distributed scattered light of high light intensity, are commercially available. Such light sources are very reliable and possess long working life. An example of such LED light source is of a height and thickness of merely 3 mm and fits excellent into said casing, even when it is mounted on substrate having a thickness of 1 to 2 mm. Besides, having a low power consumption in the order of 0.3 W, a "button battery", e.g. of the lithium type, would have sufficient capacity to serve as accumulator for emergency illumination. Such a button battery has small enough external dimensions to be disposed within the casing, on the top of the substrate for the light sources, for example. The LED type sources mentioned above have been measured to provide an average luminance of more than 100 cd/m$^2$, which is more than sufficient for the purpose of the invention.

LED light sources of this type are available which emit light of a colour such as yellow, green and red, and which may be placed inside the casing, which then, at least in its light permeable portions, should be colourless to let the light from the light sources through, without changing colour. Alternatively, at least these portions of the casing may have a predetermined colour to give the light emitting from the casing a certain desired colour, e.g. in a selected length of the assembled lighting strip. In this way it is not difficult to achieve light with a clear green colour, which usually is preferred.

In another embodiment (not shown) the colour of the travelling light emitted from a light strip module may be determined under control from the operation control equipment by disposing light sources which are capable to be controlled to emit light having a specific of a selection of colours, or by disposing further light sources, each of a different colour or of the same colour in groups, and which are wired to be switched on and off individually, in groups or as a whole. Subsequent light sources in the light strip may in this way emit light having different colours, and the colours of the light from the light sources can, by an observing person, be used as an indication of the distance to the target area, for example.

Preferably, the substrate 34 for fixing the light sources 35 inside a lighting strip casing 33 is provided with printed circuits and terminal points at the ends thereof, but the connections to the light sources may also comprise isolated cable strands.

Figure 5:
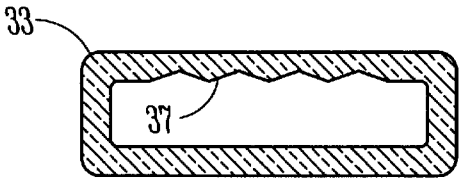
FIG. 5 shows a section through a preferred embodiment of a lighting strip casing.

To further enhance the light emitting properties of the lighting strip, an elongated casing according to the invention is preferably conFigured as optics at least in its light permeable portions, to cause light from the light sources disposed therein to gather into bundles of light for emission substantially slanting relative to a line perpendicular to the casing. FIG. 5 shows a section through a lighting strip casing 33 having such optics 37 formed on the inside of the casing, in which the angle between the emitted bundles of light and said straight line, is of a magnitude of about 20 degrees, which is a preferred value, but an angle of between 10 and 30 degrees is also possible. When a lighting strip module having such optics is placed on a floor and close to a wall, such as shown in FIG. 6A, the light bundles from the light strip which hit the wall, will reflect slantly upwards and out into the room, thereby being perceived as points of light on the wall, making the travelling light emitted from the lighting strip even more effective without being dazzling, even by emission through smoke.

Figures 6A, 6B:
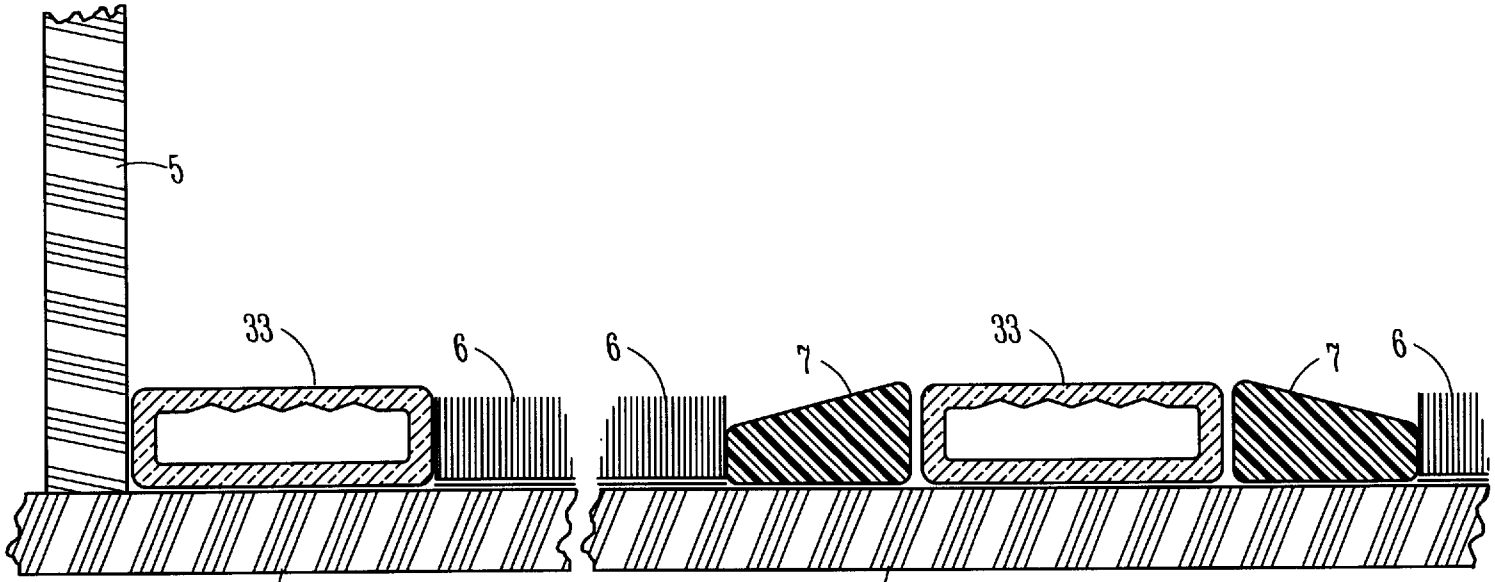
FIGS. 6A and 6B illustrate the disposition of a lighting strip according to the invention on a floor against a wall, and spaced from a wall, respectively.

Owing to small external dimensions, the impact resistance and the possibility of adhesive fixing to a foundation, the lighting strip modules according to the invention are very well suited for mounting directly on a floor 4 or deck, closely adjacent a floor rail, door sill or wall 5, such as shown in FIG. 6A, or spaced from walls, such as shown in FIG. 6B. By post-mounting on a floor covered with carpets 6, for example, a corresponding strip of the carpet is preferably cut away, so that the modules can be disposed as shown in Figures. In connection with the passing of door sills and when disposed across a floor in lobbies, for example, and other large rooms, it can be advantageous to place a reinforcing profile 7, e.g. made of aluminium, adjacent one or both of the longitudinal sides of the lighting strip, respectively, such as shown in FIG. 6B. Of course, when the structure of the floor is sufficiently rigid, the lighting strip modules may possibly be disposed lowered into the floor itself, so that their upper surface lies in the same plane as the floor.

I claim:

1. A guiding light system comprising controllable light sources which can be used as optical means for influencing persons to follow an assigned route of movement to one selected of a plurality of target areas, wherein:

said light sources are disposed along alternative routes of movement, and the system further comprising operation control means for turning light sources on and off in such a way that light sources located along the assigned route, indicate movement in the direction of the target area selected, in the form of traveling light, and wherein a centrally located part (1) of said operation control means (1,2) comprises:

display means (13) to show one or more general views selected from a collection of such general views of alternative routes of movement along which said light sources (35, 36) are located, input means (11) to designate manually, at any time, one or more of the routes of movement shown and, at any time, establish new routes of movement, or amend present routes of movement to be shown in said general view presented by the display means (13), and processing and communication means (12, 14, 21, 22) being provided to activate upon command entered through said input means (11), said traveling light from light sources (35, 36) which correspond to the respective designated route, or routes, of movement.

2. A system according claim 1, characterized in that said input means (11) is arranged to receive a signal from devices provided in the area of said routes of movement to designate one or more possible routes of movement as a function of the location of the device.

3. A system according claim 1, characterized in that said processing and communication means (12, 14, 21, 22) is arranged to automatically and/or upon command entered through said input means (11) deactivate travelling light from light sources (35, 36) which are not located along designated routes of movement.

4. A system according claim 1, characterized in that said operation control means (1, 2) is arranged to set said travelling light in accordance with a predetermined sequence of turning the light sources (35, 36) on and off, whereby this sequence can be established such that in a series of consecutively numbered light sources, the light sources along the assigned route of movement are caused to illuminate and go out in consecutively rising or falling numerical order, or with switching between light sources of odd and even numbers, respectively, in the series of light sources, possibly with switching between groups of light sources, but always such that said travelling light as a whole is perceived to indicate movement in the direction of the target area selected, preferably with a velocity of at least 2 m per second.

5. A system according claim 4, characterized in that said operation control means (1, 2) in addition is arranged to set, when needed, one or more light sources (35, 36) to emit steady light, such that these light sources may serve as stationary emergency illumination.

6. A system according to claim 1, characterized in that it comprises a plurality of lighting strip modules (34), each of which comprising an elongated casing (33) for the internal disposion of a number of light sources (35, 36), one after the other, said casing at least at each light source being light permeable, and capable of being joined to further such lighting strip modules to form a continuous lighting strip section (31).

7. A system according to claim 6, characterized in that the operation control means (1, 2) is arranged to control one or more continuous light strip sections (31) separately or collectively in one or more groups of lighting strip sections, said operation control means comprising a central control unit (1) arranged to control groups consisting of one or more lighting strip sections (31) by means of a plurality of local control units (2), each of which being associated with a respective lighting strip section (31), said local control units being adapted to receive control signals from the central control unit (1), preferably by way of wireless signal transmission (14, 21).

8. A system according to claim 7, characterized in that said local control unit (2) is arranged to set the rate and sequence by which the light sources (35) of its lighting strip section are caused to illuminate and go out, in accordance with corresponding instructions given by a control signal received from the central control unit (1), or in accordance with fixed instructions set in the local control unit.

9. A system according to claim 8, characterized in that said local control unit (2) is arranged to set the rate by which each light source of its lighting strip section is caused to illuminate and go out, in such a way that light sources (35) located one after the other in the lighting strip section (31) are caused to illuminate and go out at a constantly increasing or constantly decreasing rate in accordance with their position in the longitudinal direction of lighting strip section, thereby giving the travelling light an accelerated or decelerated movement in the direction of movement selected, and thus constitute an indication as to the distance to the target area.

10. A system according to claim 6, characterized in that said lighting strip modules (32) are designed so as to emit coloured light in the region of at least one of their light sources (35), by the provision that:

one or more of the light sources (35) provided in the casing being designed to emit light of a specific colour, one or more of the light sources (35) provided in the casing being capable of being controlled so as to emit light of a specific one of a selection of colours, or in the casing (33), further light sources are provided, each having a different colour, or the same colour when arranged in groups, whereby:

the casing (33), at least in said region, being colourless or provided with a predetermined colour to give the light emitted from the casing the desired combined colour, and said light sources being coupled so as to be illuminated and go out separately, in groups or as one single group, under the control of the operation control means (1, 2), such that the light sources of an assembled lighting strip (3) can be caused to emit light having different colours, the colour of light from the light sources being used as an indication as to the distance to the target area.

11. A system according to claim 7, characterized in that said local control unit (2) includes a separate power supply (23) connected to a mains power network and having a charging circuit for an accumulator, the capacity of which being adapted to a number of light sources of the associated light strip section (31) such that, in the case of a failure of the supply from the mains power network, these light sources are maintained active at least a predetermined period of time, by being connected to said accumulator.

12. A system according to claim 11, characterized in that said local control unit (2) is arranged to automatically connect a number of light sources (35, 36) of its light strip section (31) to said accumulator, thereby causing emission of steady light from said number of light sources, in the case of the occurance of a malfunction in the local control unit.

13. A system according to claim 7, characterized in that said local control unit (2) includes means to detect an error condition in the lighting strip section (31) associated therewith, and/or, via a connection, being associated with external means to detect a change of state in the environment of the local control means, to convey such detection to the local control unit, which, in turn, notifies the central control unit accordingly.

14. A system according to claim 6, characterized in that:

said display means (13) is arranged to indicate in its general view of alternative routes of movement being shown, the groups of lighting strip sections (31) which at any point in time have been activated, as well as the present moving direction and velocity of the travelling light within each such group, said input means (11) is arranged to indicate possible routes of movement by way of addressing corresponding lighting strip sections (31) together with an on-off sequence for the light sources and/or moving direction and velocity, and possibly colour, for the travelling light within the group concerned, and said processing and communication means (12) is arranged to bring the local control units (2) in question to activate their associated lighting strip sections (31) in agreement with the designated route, or routes, of movement, preferably by sending control signals to each designated local control unit (2) via a communications link (14, 21), the control signals specifying said moving direction and velocity, and/or on-off sequence, and possibly colour, for the light from the lighting strip section (31) concerned.

15. A lighting strip adapted to be used as optical means for influencing persons to follow one designated of two opposite directions of movement along the lighting strip, and intended for use in a guiding light system of the type comprising operation control means to control the light function of the lighting strip in such a manner that light sources located in the lighting strip indicate light transfer in the form of a traveling light in the direction of movement designated, said lighting strip comprising at least one lighting strip module (32) comprising an elongated casing (33) for the internal disposion of a number of said light sources (35), one after the other, wherein said light sources (35) are low power light sources, preferably of a type comprising light emitting diodes, emitting scattered light of high light intensity, said casing having on one side face a light permeable portion provided with optics (37), preferably formed mainly on the inside of the casing, to gather the scattered light from the light sources (35) disposed within the casing, in bundles of light for emission substantially slanting relative to a plane extending in the longitudinal direction of the casing and being perpendicular to the light permeable portion of the casing, by an angle of between 10 and 30 degrees, preferably 20 degrees, with respect to said plane, in such a way that said bundles of light appear as points of light on a reflecting field external to the lighting strip.

16. A lighting strip according to claim 15, characterized in that the middle point distance a between adjacent light sources (35) is fixed, and preferable lies in the range from 25 to 32 cm, most preferable equals 28,3 cm.

17. A lighting strip according to claim 15, characterized in that the middle point distance between adjacent light sources (35) gradually diminishes or increases in a longitudinal direction of the lighting strip (3).

18. A lighting strip according to claim 6, characterized in that said lighting strip module (32) is designed so that it can be joined to further such lighting strip modules to form a continuous lighting strip section (31).

19. A lighting strip according to claim 18, characterized in that said continuous lighting strip section (31) can be joined to other corresponding continuous lighting strip sections to form a consecutive lighting strip (3) without voids along each of the routes of movement.

20. A lighting strip according to claim 18, characterized in that said lighting strip section (31) is linked to said operation control means (1, 2) to be controlled individually therefrom, preferably by way of wireless signal transmission (14, 21).

21. A lighting strip according to claim 19, characterized in that each of said joinable lighting strip modules (31) includes four evenly distributed light sources (35) and has a length of about 1 m, preferably 113,1 cm, or includes eight such light sources (35) and has a length of about 2 m, preferably 226,3 cm, and that said casing externally has a height of about 6 to 10 mm, preferably 8 mm, and a width of 20 to 25 mm, preferably 23 mm.

22. A lighting strip according to claim 15, characterized in that on at least one longitudinal side of said casing (33), preferably on the side opposite said light permeable portion, the casing is provided with attachment means, preferably of the self adhesive type, for fixing thereof directly onto a foundation (4).

23. A lighting strip according to claim 15, wherein said light sources (35) emit evenly distributed scattered light producing an average luminance of more than 100 cd/m$^2$.

24. A guiding light system for providing visual guidance along a plurality of routes comprising:

a central controller;

a display device electrically connected to the central controller for displaying views of alternate routes of movement along the guiding light system;

a manual input device electrically connected to the central controller for receiving manual control commands from an operator;

a plurality of modular light strips disposed along the alternate routes of movement, each of the modular light strips including a plurality of light sources and a processor for controlling the plurality of lights in the modular light strip;

a communication link formed between the central controller and each of the processors of the modular light strips for providing control signals from the central controller to the plurality of modular light strips; and wherein the plurality of modular light strips are controlled to create visual guidance along a path corresponding to a selected route of movement based on input from manual input device.

25. A method of providing visual guidance along a plurality of routes of movement comprising the steps of:

providing a central controller;

providing a manual input device electrically connected to the central controller;

placing a plurality of modular light strips along alternate routes of movement, each of the modular light strips having a plurality of light sources;

providing a communication link between each of the plurality of modular light strips and the central controller;

using the manual input device to manually select a route of movement from the plurality of routes of movement; and controlling a number of the modular light strips based on the selected route of movement to provide visual guidance along the selected route of movement.

* * * * *